US012734423B2

(12) United States Patent
Dougherty

(10) Patent No.: US 12,734,423 B2
(45) Date of Patent: Sep. 15, 2026

(54) BATTING TEE ADAPTER AND SYSTEM

(71) Applicant: Jebediah Dougherty, Encinitas, CA (US)

(72) Inventor: Jebediah Dougherty, Encinitas, CA (US)

( * ) Notice: Subject to any disclaimer, the term of this patent is extended or adjusted under 35 U.S.C. 154(b) by 394 days.

(21) Appl. No.: 18/483,641

(22) Filed: Oct. 10, 2023

(65) Prior Publication Data

US 2025/0114680 A1 Apr. 10, 2025

(51) Int. Cl.
*A63B 69/00* (2006.01)

(52) U.S. Cl.
CPC ..... *A63B 69/0002* (2013.01); *A63B 69/0075* (2013.01); *A63B 2069/0008* (2013.01)

(58) Field of Classification Search
CPC ..... A63B 69/0002; A63B 69/0075; A63B 2069/0008; A63B 69/0053; A63B 71/0622; A63B 2071/0602; A63B 2071/0658; A63B 2071/0694; A63B 2209/14; A63B 2225/093
USPC ..... 473/417, 418, 422, 423, 429, 454
See application file for complete search history.

(56) References Cited

U.S. PATENT DOCUMENTS 2,664,077 A * 12/1953 Moore ..... A63B 69/407 124/16
2,858,644 A * 11/1958 Derham ..... A63H 13/16 215/316
3,667,155 A * 6/1972 Freelander ..... A63H 13/16 446/310
4,176,838 A * 12/1979 Griffin ..... A63B 69/0075 473/417
4,976,431 A * 12/1990 Guenther ..... A63B 57/10 473/417
5,120,263 A * 6/1992 Ierfino ..... A63H 13/16 273/459
6,468,126 B1 * 10/2002 Herber ..... A63H 37/00 472/51
6,761,612 B1 * 7/2004 Pencil ..... A63H 37/005 446/76
7,169,067 B2 * 1/2007 Town ..... A63B 69/00 473/422
10,549,166 B1 * 2/2020 Mueller ..... A63B 69/0002
11,413,513 B2 8/2022 Penrod et al.
2001/0034178 A1 * 10/2001 Spector ..... A63H 33/00 446/385
2005/0288120 A1 * 12/2005 Brescia ..... A63B 69/0075 473/270
2018/0043230 A1 2/2018 Gutierrez

* cited by examiner

*Primary Examiner* — Nini F Legesse
(74) *Attorney, Agent, or Firm* — Wang Hardoon, P.C.

(57) ABSTRACT

System, apparatus, and methods for a batting tee adapter and system. A batting teaching aid is disclosed to aid to train batters to not pull their head when batting. In some aspects, an adapter is disclosed that can securely fit within a cup/opening of a baseball tee. In some examples, an adapter housing is attached to a spring connected to a container that houses a randomizer element that is free moving within the container. When a ball is placed on the housing, the weight of the ball compresses the spring and lowers the container with the randomizer element. When the ball is removed, the spring will expand to a neutral position raising the container with the randomizer element. The randomizer element, being free to move in the container, may be tossed and find a new face.

19 Claims, 4 Drawing Sheets

BATTING TEE ADAPTER AND SYSTEM

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This disclosure relates generally to the field of training equipment. More particularly, the present disclosure relates to a batting tee adapter and system.

DESCRIPTION OF RELATED TECHNOLOGY

A batting tee is a "T" shaped stand used by batters as a tool to practice hitting a ball in baseball/softball. A tee can be used to hold the ball stationary for the batter to hit. By using a tee to practice hitting a stationary ball, batters can improve their swings and learn to hit balls from various locations.

Tee-ball, often stylized as T-ball, is a simplified version of baseball or softball designed primarily for young children. The name comes from the tee used by batters to hit the ball rather than a pitcher throwing the ball in traditional baseball/softball. Tee-ball serves as an introduction to the basic skills and concepts of these sports, such as hitting, running, and fielding, in a less complex and more accessible format. In tee-ball, an adjustable-height fixed tee holds a ball atop the home plate at a suitable height for the batter to strike.

Batters want to see the result of their effort. One frequent problem encountered by batters is that the batter will move their head prematurely, losing sight of the ball (whether pitched or stationary off a tee). This is similar to a batter closing their eyes and trying to hit the ball. Coaches may use various training techniques to train batters who "pull their head" to improve their batting technique.

One of the drills used by coaches to train a batter to keep looking at the tee after hitting the ball involves a coach displaying (flashing) a number of fingers behind the tee and ball (from the perspective of the batter) after the swing, which the batter can call out after the swing to indicate that they kept their head down. Such drills, however, require a coach (as the drills cannot be performed by a batter alone) and the coach must be in close proximity to the batter to flash their fingers in a way visible by the batter which may be dangerous (e.g., due to the proximity) and require fast reaction time on the part of the coach to time their sign with the batter's swing.

Batting tees have been created that attempt to solve the foregoing problem. For example, a batting tee with lights that flash colors when a ball is hit have been designed. These batting tees, however, are full tees and cannot be used with the many batting tees already in use, are powered (e.g., require batteries) and changing batteries over time, and are complex mechanisms that increase the cost of production with more parts liable to malfunction.

DETAILED DESCRIPTION

Figure 1:
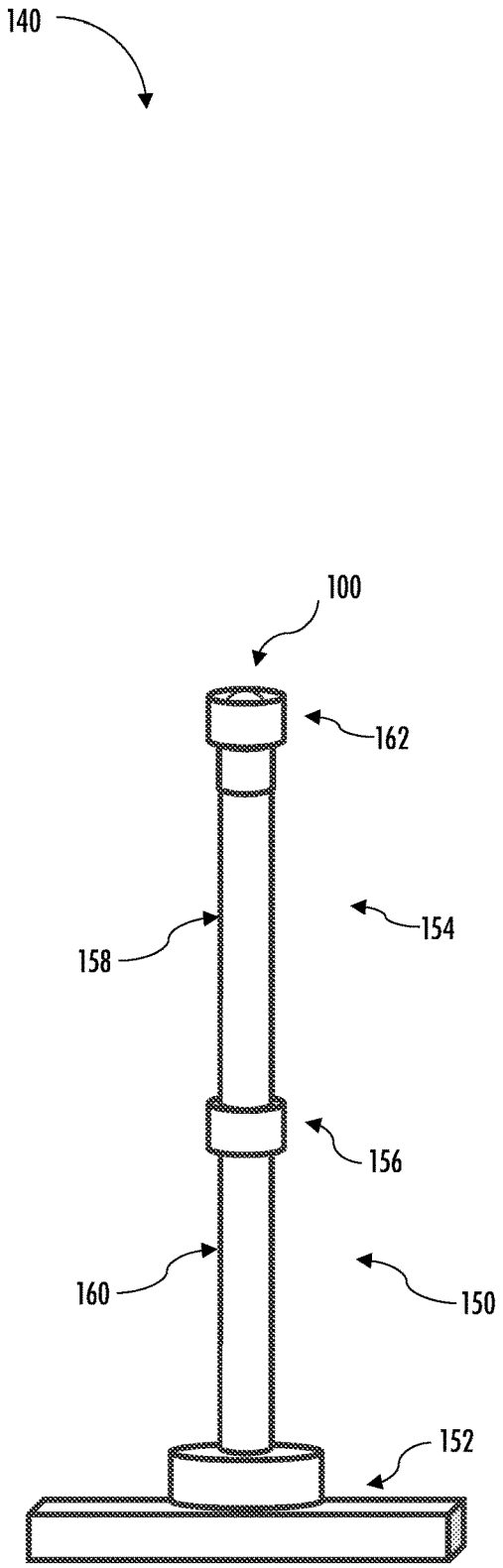
FIG. 1 illustrates a batting tee adapter installed in a batting tee forming a batting teaching aid system according to aspects of the present disclosure.

In the following detailed description, reference is made to the accompanying drawings which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without departing from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Example Operation

According to aspects of the present disclosure, a batting teaching aid is disclosed to aid to train batters to not pull their head/keep their head down when batting in baseball, softball, and/or tee-ball. In some aspects, an adapter is disclosed that can securely fit within a cup/opening of a baseball tee. Advantages of an adapter plug include the ability to be used in various baseball tees. In some examples, the disclosed adapter plug solves problems of the prior art by providing a non-powered device which may allow for a simpler and less costly process to manufacture and ease of use by batters and coaches without the need for separate specialized tees (e.g., there is no need to replace batteries) or bring multiple batting tees.

In some examples, the adapter has an outer housing configured to fit within a cup/opening of the baseball tee. The adapter is configured to snugly fit into the baseball tee such that the adapter does not become dislodged from the tee during typical/expected use (e.g., if the tee or a ball sitting on the adapter is hit with a bat at typical speeds/with typical force). A receiving aperture in the housing is configured to hold a ball (e.g., a baseball/softball) in place for a batter to hit.

In some examples, the housing is attached to a spring connected to a clear container that houses a die that is free moving within the container. When a ball is placed on the housing (at the receiving aperture), the weight of the ball compresses the spring and lowers the container with the die. When the ball is removed (e.g., hit by the batter), the spring will expand to a neutral position raising the container with the die. The die, being free to move in the container, will be tossed and find a new face. The new face may then be called out by the batter indicating that they were watching the ball.

Figure 2:
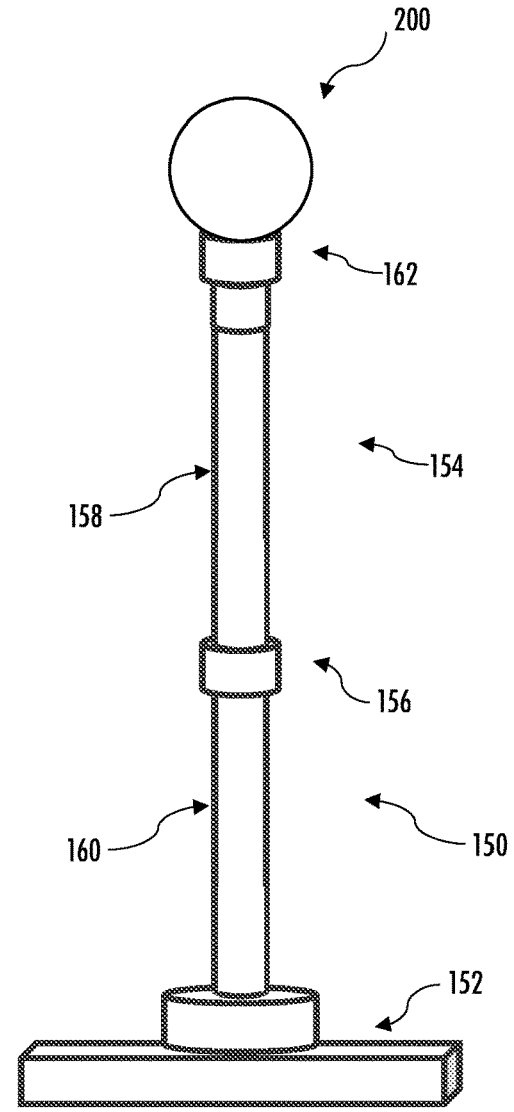
FIG. 2 illustrates a ball placed on the batting tee adapter shown in FIG. 1, according to aspects of the present disclosure.

FIG. 1 illustrates a batting tee adapter 100 installed in a batting tee 150 forming a batting teaching aid system 140 according to aspects of the present disclosure. FIG. 2 illustrates a ball 200 placed on the batting tee adapter 100 shown in FIG. 1.

Batting tee 150 includes a base 152, a vertical shaft 154 including an adjustment knob 156 to adjust the height of the batting tee 150. In some examples, a ball 200 may be placed on the vertical shaft 154 of the batting tee enabling a batter to hit the ball off the batting tee 150. The batting tee 150 may be made of metal, rubber, plastic, etc. or a combination of materials as would be understood by one of ordinary skill given the contents of this disclosure. Components of the batting tee 150 may be made with a variety of components.

The base 152 is configured to provide stability to the batting tee 150. The base 152 may have a square footprint or may be shaped like home plate (e.g., an irregular pentagon with two parallel sides, where each of the two parallel sides perpendicular to a base). Other footprints for the base 152 may be used with equal success. In some examples, to enhance stability, batting tee 150 includes a weighted base that adds extra weight to prevent batting tee 150 from tipping over or moving/shifting position during use.

The height of the batting tee 150 (and the height of the ball 200 when placed on the batting tee 150) may be adjusted using the adjustment knob 156. Adjustable height may be useful for accommodating different types of pitches or players of various heights. The adjustment knob 156 may be rotated to a tightened configuration or a loosened configuration. The adjustment knob 156, when in a tightened configuration, may provide tension to the vertical shaft 154 locking upper elements 158 and lower elements 160 of the vertical shaft 154 in place. When in a loosened configuration, the adjustment knob 156 may allow the upper elements 158 to telescope within the lower elements 160 of the vertical shaft 154.

The vertical shaft 154 of the batting tee 150 may include a ball holder 162. The ball holder 162 may include an aperture at the upper end (opposite the base 152) of the ball holder 162. The aperture may open to a cup or cavity inside the ball holder 162 and/or vertical shaft 154. The ball holder 162 may be configured to hold the ball 200 in place for a batter to hit. In some examples, the ball holder 162 is a flared or enlarged portion of the vertical shaft 154. In some examples, the ball holder 162 may provide a stop for a vertical shaft 154 that telescopes as the outer diameter of the ball holder 162 is larger than a diameter of the adjustment knob 156 or the lower elements 160 of the vertical shaft. This may stop the upper elements 158 from falling within lower elements 160 of the vertical shaft 154 (when the adjustment knob 156 is in a loosened configuration).

Figure 3:
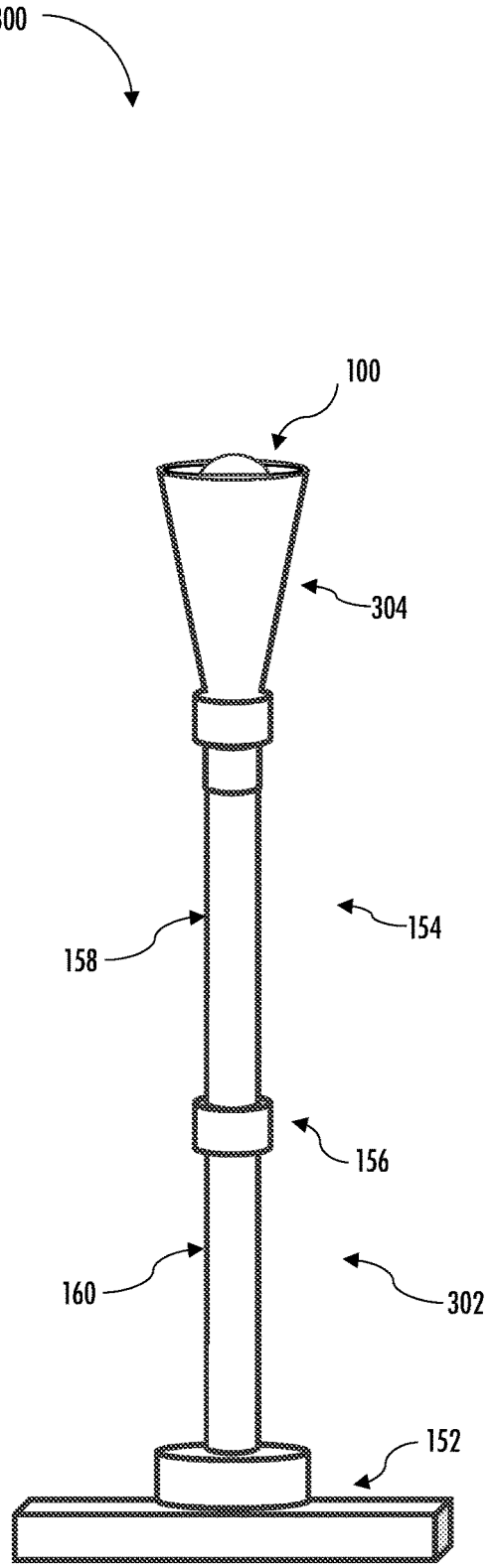
FIG. 3 illustrates a batting tee adapter installed in a batting tee forming a batting teaching aid system, according to aspects of the present disclosure.
Figure 4:
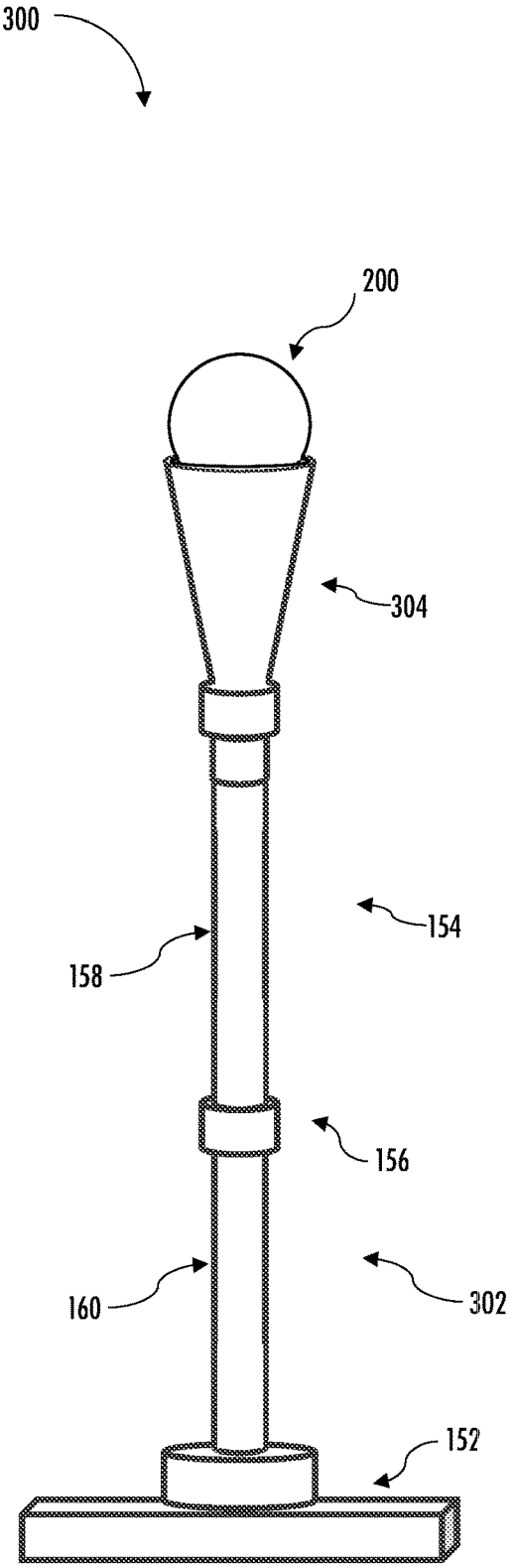
FIG. 4 illustrates a ball placed on the batting tee adapter of FIG. 3, according to aspects of the present disclosure.

FIG. 3 illustrates a batting tee adapter 100 installed in a batting tee 302 forming a batting teaching aid system 300 according to aspects of the present disclosure. The batting tee 302 includes a ball holder 304 on the vertical shaft 154. The ball holder 304 has a conical or frustoconical shape (with a smaller/narrower end having a smaller diameter and a larger/wider end having a larger diameter). FIG. 4 illustrates a ball 200 placed on the batting tee adapter 100 of FIG. 3.

A batting tee adapter 100 may be installed in the batting tee 150, 302. The ball holder 162, 304 has a circular opening to accommodate the ball 200 and the batting tee adapter 100. As illustrated (in FIGS. 1 and 3), the batting tee adapter 100 when installed in the batting tee 150, 302 may sit flush with the ball holder 162, 304. In other examples, the batting tee adapter 100 may sit lower (e.g., below the opening in the ball holder 162, 304) when installed on the batting tee 150, 302. In further examples, the batting tee adapter 100 may rest above (e.g., above the opening in the ball holder 162/flared ball holder 304) when installed on the batting tee 150, 302.

During operation, the batting tee adapter 100 may be placed inside a cavity in the ball holder 162, 304 and held in place with friction. The ball 200 may be placed on the batting teaching aid system 140, 300 and hit by a batter off the batting tee 150, 302 with the batting tee adapter 100 placed inside.

In some examples, the batting tee adapter 100 is a separate unit installed inside the batting tee 150, 302. In other examples, the batting tee adapter 100 is a non-removable part of the batting tee 150, 302, e.g., where the outer housing of the batting tee adapter 100 is built into the ball holder 162, 304.

Figure 5:
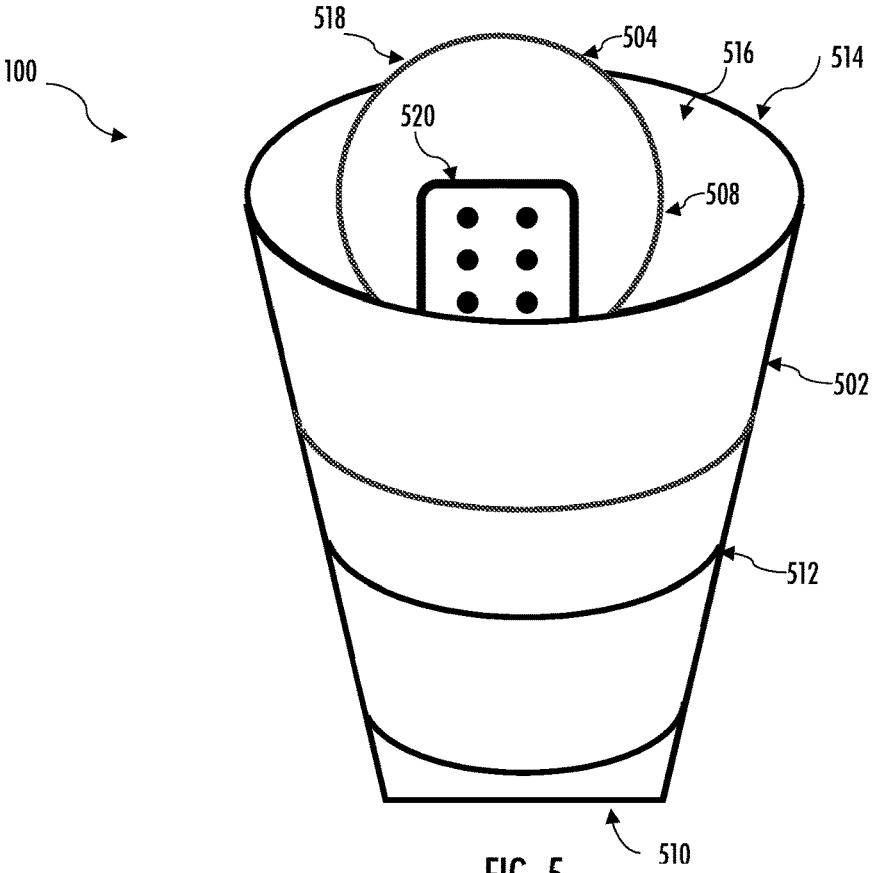
FIG. 5 illustrates batting tee adapter, according to aspects of the present disclosure.
Figure 6:
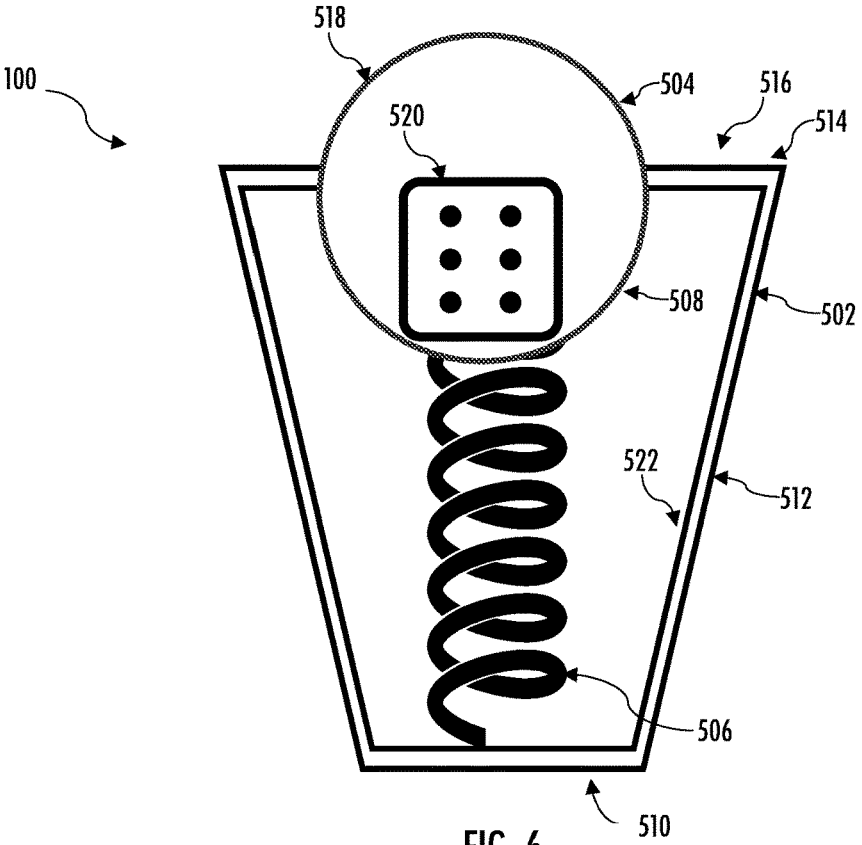
FIG. 6 is a cross-sectional view of the batting tee adapter illustrated in FIG. 5, according to aspects of the present disclosure.
Figure 7:
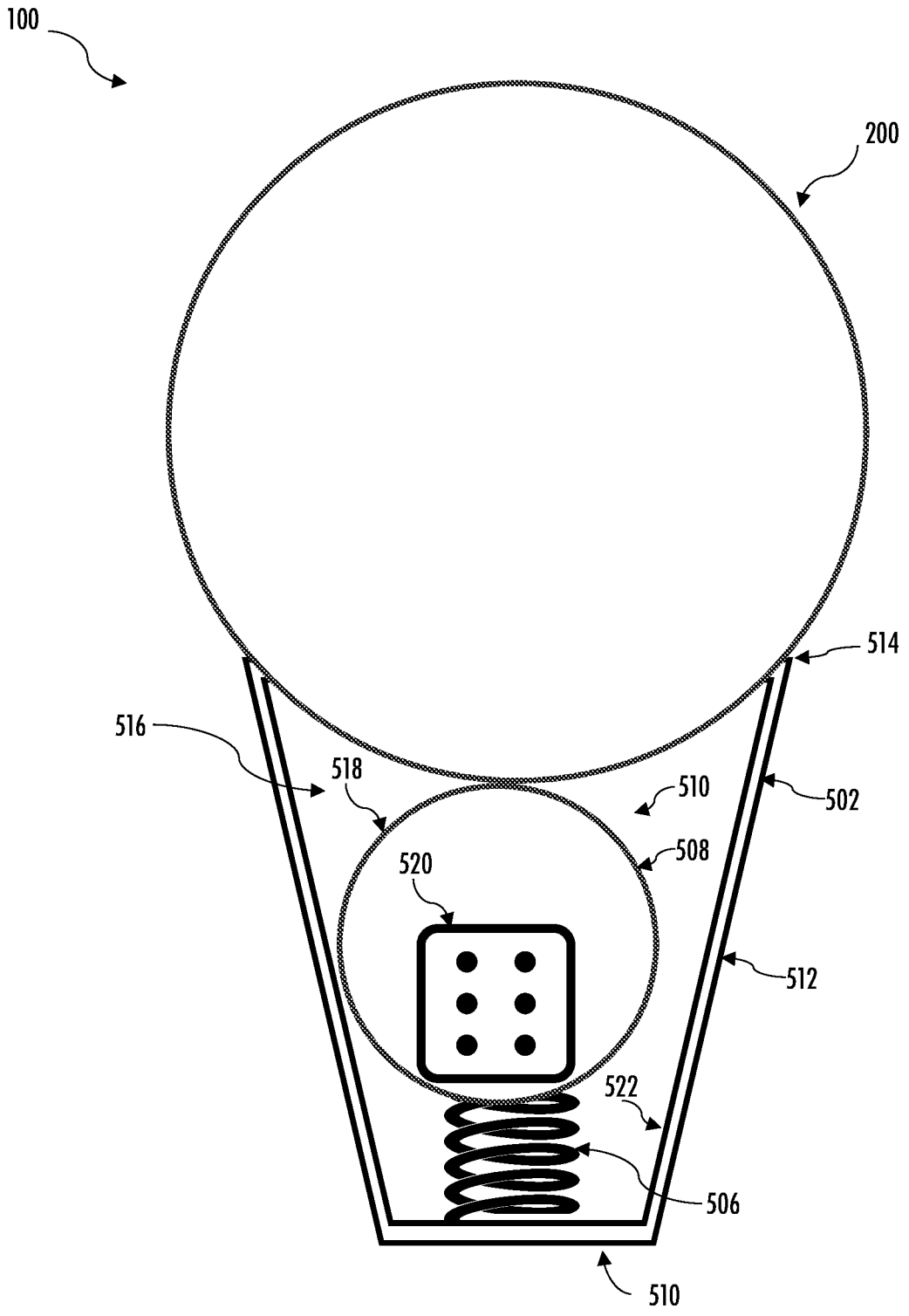
FIG. 7 is a cross-sectional view of the batting tee adapter, illustrated in FIG. 5, with an installed ball, according to aspects of the present disclosure.

FIG. 5 illustrates batting tee adapter 100 according to aspects of the present disclosure. FIG. 6 is a cross-sectional view of the batting tee adapter 100 illustrated in FIG. 5. FIG. 7 is a cross-sectional view of the batting tee adapter 100 with an installed ball according to aspects of the present disclosure.

The batting tee adapter 100 includes adapter housing 502 and a popup element 504. The popup element 504 may be located in the adapter housing 502 and may include a spring 506 affixed to the adapter housing 502, and a randomizer 508 coupled to the spring 506. The adapter housing 502 may be configured to couple to and fit within a ball holder of a batting tee. In some examples, the adapter housing 502 is configured to be installed within a ball holder such that a rim 514 remains flush with or within (e.g., below) a ball mount of the batting tee.

The adapter housing 502 may include an adapter base 510, side walls 512, and a rim 514. The rim 514 may encircle the outer edge of a cavity 516 (a ball mounting cavity) in the adapter housing 502 with an interior surface 522 of the adapter housing 502. The rim 514 and the cavity 516 may be configured to hold a ball (e.g., a baseball or a softball). In some examples, the side walls 512 of the adapter housing 502 are tapered with a wider upper portion (by the rim 514) and a narrower portion at the adapter base 510. In further examples, the adapter housing 502 has a frustoconical shape, with a wider portion at the rim 514 and a narrower portion at the adapter base 510. In other examples, the adapter housing 502 has a cylindrical shape with a diameter at the adapter base 510 being substantially similar to the diameter at the rim 514. In still further examples, the adapter housing 502 has a portion with a cylindrical shape and a portion with a tapered shape.

The adapter housing 502 may be constructed from a material such as rubber or rubber-like (e.g., polyurethane, neoprene, or other polymer), cork, a resin bonded cork, epoxy resin, or any other material that has a high coefficient of friction with the ball holder of a batting tee. In some examples, friction holds the adapter housing 502 sufficiently within the ball holder of the batting tee such that such that the batting tee adapter 100 does not become dislodged from the ball mount of the batting tee by gravity. In some examples, friction holds the adapter housing 502 sufficiently within the ball holder of the batting tee such that such that batting tee adapter 100 does not become dislodged from the ball mount of the batting tee when hit by a bat. In some examples, the side walls 512 have outwardly projected ridges to increase the frictional engagement between the batting tee and the batting tee adapter 100. In other examples, the adapter housing 502 is coupled to the ball mount of the batting tee with a temporary or permanent adhesive (e.g., glue, tape, hook and loop fasteners, etc.).

In some examples, a string, strap, or tab is coupled to the adapter housing 502 (e.g., at the adapter base 510) and is configured to dislodge or otherwise remove the batting tee adapter 100 from the ball holder of the batting tee. To remove the adapter housing 502, the string/strap/tab may be pulled away from the ball holder releasing at least a portion of the adapter housing 502 from the ball holder.

The spring 506 may be coupled to the adapter housing 502. In some examples, the spring 506 is coupled to the adapter housing 502 by having a first portion of the spring inserted within the adapter housing 502. In some examples, the adapter housing 502 holds the spring 506 in a position normal to the adapter base 510 (e.g., a vertical orientation as illustrated in FIGS. 5-7). A washer, or a post inserted inside the coil of the spring 506, in the adapter base 510 may secure the inserted spring 506 to the adapter base 510. A spring retainer (secured, e.g., by a hole or cavity in the adapter base 510) may secure the inserted spring 506. The adapter base 510 may secure the spring 506 with glue, epoxy, or resin. In other examples, adapter housing 502 may cure around the spring 506 secured to the adapter base 510.

The spring 506 may be configured to compress into a compressed configuration (illustrated in FIGS. 5 and 6) when a ball is placed on the adapter housing 502. In some examples, the ball is not placed directly on the spring 506, but instead acts indirectly on the spring 506. For example, the ball may exert a force on the randomizer 508 that is coupled to and compresses the spring 506 to the compressed configuration. The spring 506 may be configured to de-compress/extend into an uncompressed configuration (illustrated in FIG. 7) when the ball is removed (after, e.g., being hit with a bat by a batter). The spring 506 may be configured to exert a force on and push the randomizer 508 toward the rim 514 of the adapter housing 502 when de-compressing from the compressed to uncompressed configuration. The randomizer 508 may be configured, in the uncompressed state to be partially (or completely) outside the cavity 516 when the spring 506 is in the uncompressed configuration.

In some examples, the spring 506 may include a helical (e.g., coil) compression spring or any other mechanism that can exert a force on the randomizer 508 (lifting the randomizer 508 toward the rim 514 of the adapter housing 502) and/or be compressed by a ball (e.g., when the ball is placed on the batting tee adapter 100). In some examples, the spring 506 may be made of metal (e.g., steel, aluminum, etc.) or plastic. In some examples, the spring 506 may be covered by a protective cover to shield the spring 506 (e.g., from dirt and debris). The protective cover may compress and decompress along with the spring 506. In some examples, the protective cover is attached to the randomizer 508 and the adapter housing 502.

In some examples, the spring 506 may be compressed from the force of the weight of a ball (e.g., a baseball or softball) such that the randomizer 508 is fully enclosed within the cavity 516 of the adapter housing 502 when the spring 506 is in the compressed state. The force of the spring 506/randomizer 508 on the ball does not cause the ball to be unstable on (or dislodge/fall out from) the rim 514 and the cavity 516 of the adapter housing 502. In other words, the cavity 516 may hold the ball in a static/stationary position while the spring 506 is in the compressed configuration. When the ball is removed from the rim 514/cavity 516 of the adapter housing 502, in some examples, the spring 506 rebounds with sufficient speed to change the orientation of the randomizer 508.

The randomizer 508 may be coupled to the spring 506. In some examples, the randomizer 508 may be joined to the spring 506 via an epoxy, silicone, cyanoacrylate or other similar bonding agents, or during a curing process of the randomizer 508. In other examples, a portion of the spring 506 may be inserted into the randomizer 508.

The randomizer may include a randomizer housing 518 and a randomizer element 520. The randomizer housing 518 is configured to contain the randomizer element 520 with enough freedom of movement to change configuration. In some examples, the randomizer element 520 fully encapsulates the randomizer element 520. In some examples, the randomizer housing 518 includes a transparent plastic sphere/ball. In other examples, the randomizer housing 518 has another shape (e.g., a cube, rectangular prism, oval/egg shape, etc.). In other examples, the randomizer housing 518 includes a partially transparent container with a portion/window that is transparent such that a batter can view the randomizer element 520 through the transparent portion. In some examples, the randomizer housing 518 includes a transparent half sphere coupled to a base portion coupled to the spring 506. The base portion may be a flat base or a non-transparent half sphere.

The randomizer element 520 may be configured to change configuration based on the movement of the randomizer 508/batting tee adapter 100. For example, when a ball is placed on the batting tee adapter 100, the randomizer 508 may be lowered along with the spring 506 in the compressed configuration by the weight of the ball. The randomizer 508 may be located entirely within cavity 516. Upon being hit by a batter, the weight of the ball is removed from the batting tee adapter 100 and the spring 506 changes configuration to the uncompressed configuration lifting the randomizer 508/randomizer housing 518. In some examples, the movement of the randomizer 508/randomizer housing 518 causes the randomizer element 520 to move within the randomizer housing 518 that may cause a change in the orientation or configuration of the randomizer element 520. A batter may then view the orientation/configuration of the randomizer element 520 within the randomizer housing 518. In some examples, the batter can call out the orientation of the randomizer element to a coach to indicate they kept their head down on the ball as they hit the ball (rather than lift their head early to see where the ball would go) training the batter's movement.

In some examples, the randomizer element 520 can be any device that can change configuration and be observed by a batter. In one example, the randomizer element 520 is a die. In some examples, the die is a six-sided die (cube) though other die shapes may be used with equal success (e.g., 4-sided die (tetrahedron), 8-sided die (octahedron), a 10-sided die (pentagonal trapezohedron), a 12-sided die (dodecahedron), a 20-sided die (icosahedron), etc.). The randomizer element 520 may include a disk (e.g., a coin/token), or spherical shape. In many examples, the randomizer element 520 is "fair" with an equal likelihood of landing in any configuration. In other examples, the randomizer element 520 is "loaded" with differing likelihoods of landing in the different possible configurations.

The randomizer element 520 may have various configurations/orientations. The configuration may be based on the symbol, shape, or color shown on a particular portion/face (e.g., a face on the side closest to the rim 514 of the adapter housing 502) of the randomizer element 520. For example, the randomizer element 520 may include numbers (e.g., in Arabic numerals or as pips), letters (e.g., upper or lowercase Latin letters), words, shapes (e.g., circle, square, triangle, plus-sign, minus-sign, a blank face), colors (e.g., red, yellow, orange, blue, green, purple, black, white, etc.), or virtually any other symbol that can be quickly identified by a batter. In some examples, multiple randomizer elements are used in tandem, with the same or different configurations.

In some examples, the randomizer housing 518 is coupled to the adapter housing 502 (without a spring) and remains static with respect to the adapter housing 502. The randomizer element 520 may change orientation by the movement of the adapter housing 502. In these cases, the randomizer housing 518 is configured to be coupled to the interior surface 522 of the adapter housing 502 such that the randomizer housing 518 does not interfere with the placement and stability of the ball on the adapter housing 502/batting tee adapter 100 but can be seen by a batter after hitting the ball when the batting tee adapter 100 is installed in a batting tee. In one specific example, the randomizer housing 518 may be attached to the interior surface 522 of the adapter housing 502 at the adapter base 510.

In some examples, a batting tee (e.g., with the features of batting tee 150, 302 of FIGS. 1-4) may include the popup element 504 (e.g., the randomizer 508 and/or the spring 506) inside the ball holder (e.g., ball holders 162, 304 of FIGS. 1-4) directly as a single unit, rather than as part of an insertable batting tee adapter.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A batting tee adapter comprising:

an adapter housing couplable to a batting tee, the adapter housing having a rim along an outer edge of a ball mounting cavity, the ball mounting cavity comprising an interior surface;

a spring having a first portion and a second portion, the first portion of the spring coupled to the interior surface; and a randomizer coupled to the second portion of the spring, wherein:

the randomizer comprises:

a randomizer housing having a transparent portion, the randomizer housing coupled to the second portion of the spring; and a randomizer element having a plurality of orientations, enclosed within the randomizer housing and configured to change orientation of the plurality of orientations, and the spring is configured to compress to a compressed configuration and the spring is configured to lift the randomizer toward the rim of the adapter housing when in an uncompressed configuration.

2. The batting tee adapter of claim 1, wherein the randomizer element is configured to change the orientation when the spring changes configuration from the compressed configuration to the uncompressed configuration.

3. The batting tee adapter of claim 1, wherein the randomizer element is a six-sided die with a differing number of pips on each face of the six-sided die.

4. The batting tee adapter of claim 1, wherein the randomizer element is a six-sided die with differing colors on each face of the six-sided die.

5. The batting tee adapter of claim 1, wherein the randomizer housing comprises a clear plastic ball.

6. The batting tee adapter of claim 1, wherein the randomizer is configured to be viewable by a batter when the adapter housing is coupled to the batting tee and the spring is in the uncompressed configuration.

7. The batting tee adapter of claim 1, wherein:

the ball mounting cavity is configured to place a ball, the spring is configured to compress to the compressed configuration when the ball is on the ball mounting cavity, and the spring is configured to extend to the uncompressed configuration when the ball is not on the ball mounting cavity.

8. The batting tee adapter of claim 7, wherein the randomizer is configured to compress the spring when the ball is placed on the ball mounting cavity causing the spring to change from the uncompressed configuration to the compressed configuration.

9. The batting tee adapter of claim 7, wherein the ball mounting cavity is configured to hold the ball in a stationary position while the spring is in the compressed configuration.

10. An apparatus comprising:

a frustoconical adapter housing couplable to a batting tee, the frustoconical adapter housing having a rim along an outer edge of a ball mounting cavity on a larger diameter portion of the frustoconical adapter housing, the ball mounting cavity comprising an interior surface;

a spring having a first portion and a second portion, the first portion of the spring coupled to the interior surface at a smaller diameter portion of the frustoconical adapter housing, wherein the spring is configured to compress to a compressed configuration and extend to an uncompressed configuration;

a transparent sphere coupled to the second portion of the spring, the transparent sphere located entirely within the ball mounting cavity of the frustoconical adapter housing when the spring is in the compressed configuration and the transparent sphere is located at least partially outside the ball mounting cavity of the frustoconical adapter housing when the spring is in the uncompressed configuration; and a die enclosed by the transparent sphere.

11. The apparatus of claim 10, further comprising the batting tee coupled to the frustoconical adapter housing.

12. A batting tee adapter comprising:

an adapter base couplable to a batting tee;

a spring having a first portion and a second portion, the first portion of the spring coupled to the adapter base; and a randomizer coupled to the second portion of the spring, the randomizer comprises:

a randomizer housing having a transparent portion, the randomizer housing coupled to the second portion of the spring; and a randomizer element having a plurality of orientations, enclosed within the randomizer housing and configured to change orientation of the plurality of orientations, wherein the spring is configured to compress to a compressed configuration and the spring is configured to lift the randomizer away from the adapter base when in an uncompressed configuration.

13. The batting tee adapter of claim 12, wherein the spring comprises a helical spring.

14. The batting tee adapter of claim 12, further comprising a spring cover that encloses the spring, wherein the spring cover is coupled to the adapter base.

15. The batting tee adapter of claim 12, wherein the adapter base comprises a rubberized material and securable by friction within a ball mount of the batting tee such that the batting tee adapter does not become dislodged from the ball mount of the batting tee by gravity.

16. The batting tee adapter of claim 12, wherein the adapter base comprises cork.

17. The batting tee adapter of claim 12, further comprising a frustoconical adapter housing comprising the adapter base, the frustoconical adapter housing having a rim along an outer edge of a ball mounting cavity on a larger diameter portion of the frustoconical adapter housing.

18. The batting tee adapter of claim 17, wherein:

the ball mounting cavity has an interior surface, and the spring couples to the interior surface of the frustoconical adapter housing at a narrow end.

19. The batting tee adapter of claim 17, wherein the frustoconical adapter housing is configured to be installed within a ball mount of the batting tee such that the rim is flush with or within the ball mount of the batting tee.

* * * * *